US006363694B1

(12) United States Patent
Riedinger

(10) Patent No.: US 6,363,694 B1
(45) **Date of Patent: *Apr. 2, 2002**

(54) BAG FOR USE IN AN AUTOMATIC BAG FILLING PROCESS

(75) Inventor: Ross Riedinger, Wenatchee, WA (US)

(73) Assignee: International Paper Company, Purchase, NY (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/055,872

(22) Filed: Apr. 6, 1998

(51) Int. Cl.[7] ..... B65B 5/06; B65B 43/30
(52) U.S. Cl. ..... 53/459; 53/572
(58) Field of Search ..... 383/9, 35, 37; 53/459, 572, 573, 384.1

(56) References Cited

U.S. PATENT DOCUMENTS

| | | | | | |
|---|---|---|---|---|---|
| 3,312,339 | A | | 4/1967 | Million | 206/57 |
| 3,329,260 | A | * | 7/1967 | Medleycott | 53/572 |
| 3,468,100 | A | | 9/1969 | Rubel | 53/189 |
| 3,727,374 | A | | 4/1973 | Williams | 53/189 |
| 3,779,449 | A | * | 12/1973 | Membrino | 53/459 |
| 3,822,527 | A | | 7/1974 | Germunson et al. | 53/189 |
| 3,889,449 | A | | 6/1975 | Membrino | 53/189 |
| 4,137,958 | A | | 2/1979 | Golby et al. | 150/1 |
| 4,177,621 | A | * | 12/1979 | Powell, Jr. | 53/572 |
| 4,368,608 | A | | 1/1983 | Ray | |
| 4,558,556 | A | * | 12/1985 | Jostler | 383/37 |
| 4,760,684 | A | * | 8/1988 | Crosby | 53/459 |
| 4,798,042 | A | | 1/1989 | Davis | 53/572 |
| 5,174,094 | A | | 12/1992 | Powell | 53/469 |
| 5,442,898 | A | | 8/1995 | Gabree et al. | 53/459 |
| 5,452,559 | A | * | 9/1995 | Lipes | 53/572 |
| 5,457,944 | A | | 10/1995 | Lipes | 53/572 |

* cited by examiner

*Primary Examiner*—John Sipos
(74) *Attorney, Agent, or Firm*—Thompson Hine LLP

(57) ABSTRACT

A bag for use in an automatic bagging apparatus, said bag comprising:

a back panel having a top edge, a bottom edge and first and second side edges; and a front panel having a top edge, a bottom edge and first and second side edges, the back panel being longer than the front panel, wherein the back panel includes a tear line which runs parallel to the top and bottom edges of the back panel and extends between the side edges thereof, the tear line including a middle portion which is perforated and two lateral portions which are cut and intersect the side edges of said back panel, the front panel being juxtaposed with the back panel such that the side edges and bottom edges are contiguous, the front panel being joined to the back panel along their corresponding side edges and bottom edges is disclosed.

5 Claims, 5 Drawing Sheets

BAG FOR USE IN AN AUTOMATIC BAG FILLING PROCESS

BACKGROUND OF THE INVENTION

The present invention relates to open mouth bags which may be used in existing automatic bag filling processes, and more particularly to an improved construction of a bag for use in a wicketed assembly or assembly of bags which provides improved automatic filling of articles such as vegetables and fruit, e.g., potatoes, apples, oranges, cherries and the like into an open mouth bag.

Bags constructed of thermoplastic material, such as polyethylene, polypropylene, etc., are generally made by cutting through a strip of double-ply material at successive intervals by means of a heat knife, wire or the like, which simultaneously cuts through and heat-seals the cut edges of the overlying plys together. These bags are ordinarily difficult to open because the walls of the bag tend to adhere to each other. This is an especially disadvantageous feature when the bags are used in commercial production where they must be easily opened by automated bag filling equipment in order to make automated processes feasible.

In automated bag filling equipment, the bags often are mounted in large numbers or assemblies on wickets, clamps or other devices that allow the bagging system to access the bags. In a typical bagging system each bag is opened individually and filled with a product. One example of this type of automatic equipment is disclosed in Germunson et al., U.S. Pat. No. 3,822,527. Germunson discloses an automated bagging system that opens a wicketed assembly of bags using a jet of air followed by the insertion of a scoop. The wicketed assembly of bags is positioned at the end of a chute, down which measured amounts of fruits or other material are fed. The initial jet of high pressure air blows the bag open so that a scoop can enter the bag and support the bag edges to provide a wide opening for the fruit to enter the open bag.

Several drawbacks exist in prior automated bagging systems. In particular, the blast of air does not always open the bag completely. During the bagging process the spatial relationship between the lip of the top bag and air jet changes as the bags are used. If the air is correctly aligned to open the bag when a new assembly of bags is placed on the machine, this alignment may not be correct for the jet of air to open the bags that are located deeper in the assembly. As a result it is not unusual for the operator to have to watch the bags as they are opened and to have to assist manually in opening the bags on some occasions.

It has been now found that the difficulties noted above can be overcome by the simple but highly effective operation of providing preformed cuts at each side of the bag, which are horizontally aligned with, but off-set from the lip of the bag opening. The cuts allow jets of air directed into the bag to easily and reliably inflate the bags so that the scoops can be inserted.

SUMMARY OF THE INVENTION

According to the present invention a bag for use on automated bagging equipment is provided wherein the bag comprises:

a back panel having a top edge, a bottom edge and first and second side edges; and a front panel having a top edge, a bottom edge and first and second side edges, the back panel being longer than the front panel, wherein the back panel includes a tear line which runs parallel to the top and bottom edges of the back panel and extends between the side edges thereof, the tear line including a middle portion which is perforated and two lateral portions which are cut and intersect the side edges of said back panel, the front panel being juxtaposed with the back panel such that the side edges and the bottom edges are contiguous, the front panel being joined to the back panel along their corresponding side edges and bottom edges.

The present invention also provides an assembly of bags wherein each bag has the structure identified above.

The invention also provides an improved automatic bagging method for opening and filling a bag in a wicketed assembly of bags with a product including the sequential steps of automatically:

inflating each bag in the wicketed assembly of bags with air;

holding the inflated bag open with a pair of spreader arms;

filling the inflated bag with the product; and detaching the filled bag from the assembly, the improvement wherein the wicketed assembly includes a plurality of bags wherein each bag comprises:

a back panel having a top edge, a bottom edge and first and second side edges; and a front panel having a top edge, a bottom edge and first and second side edges, the back panel being longer than the front panel, wherein the back panel includes a tear line which runs parallel to the top and bottom edges of the back panel and extends between the side edges thereof, the tear line including a middle portion which is perforated and two lateral portions which are cut and intersect the side edges of the back panel, the front panel being juxtaposed with the back panel such that the side edges and the bottom edges are contiguous, the front panel being joined to the back panel along their corresponding side edges and bottom edges.

DETAILED DESCRIPTION OF THE INVENTION

Figure 1:
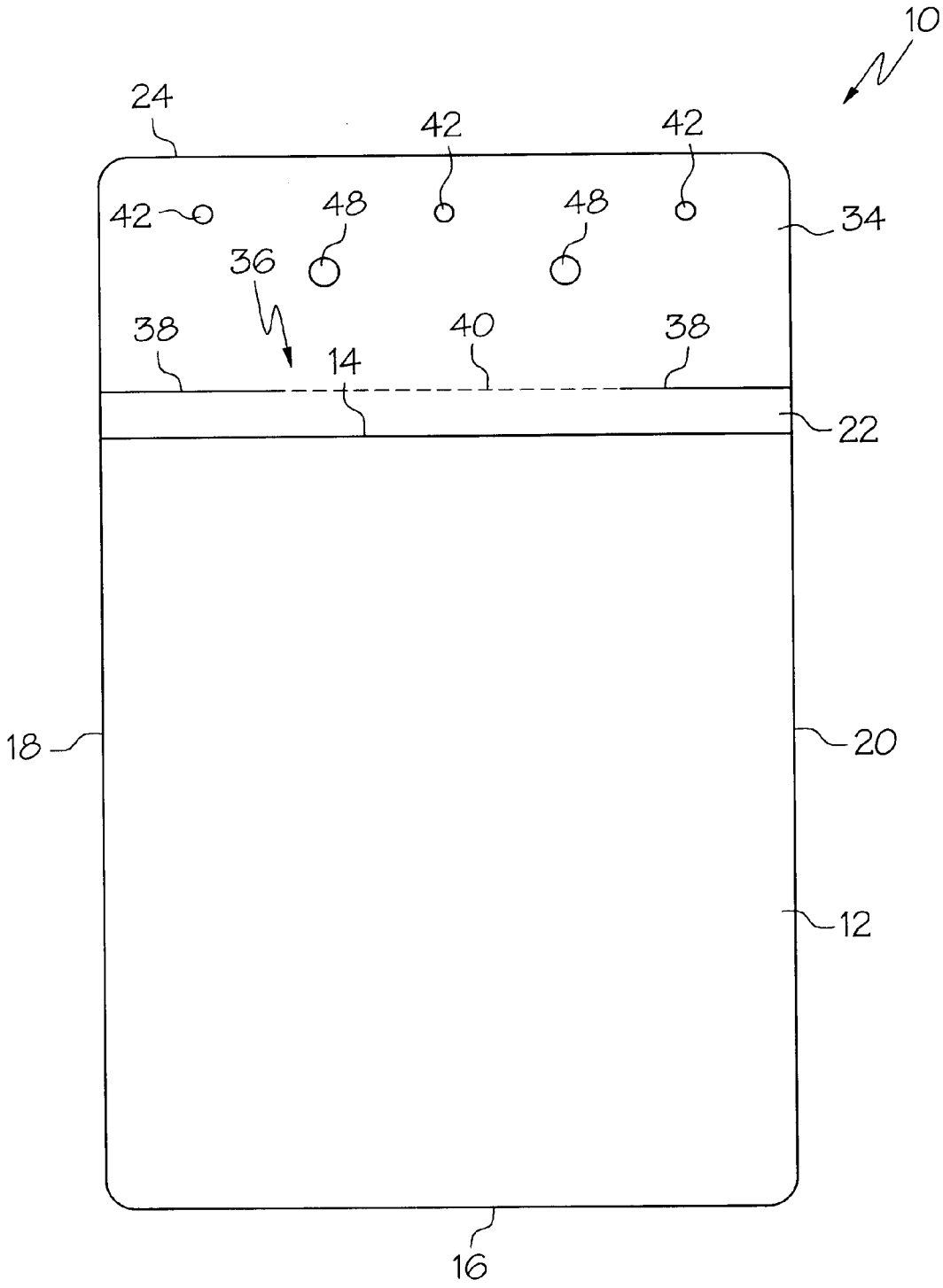
FIG. 1 is a front view of a bag according to the invention.
Figure 2:
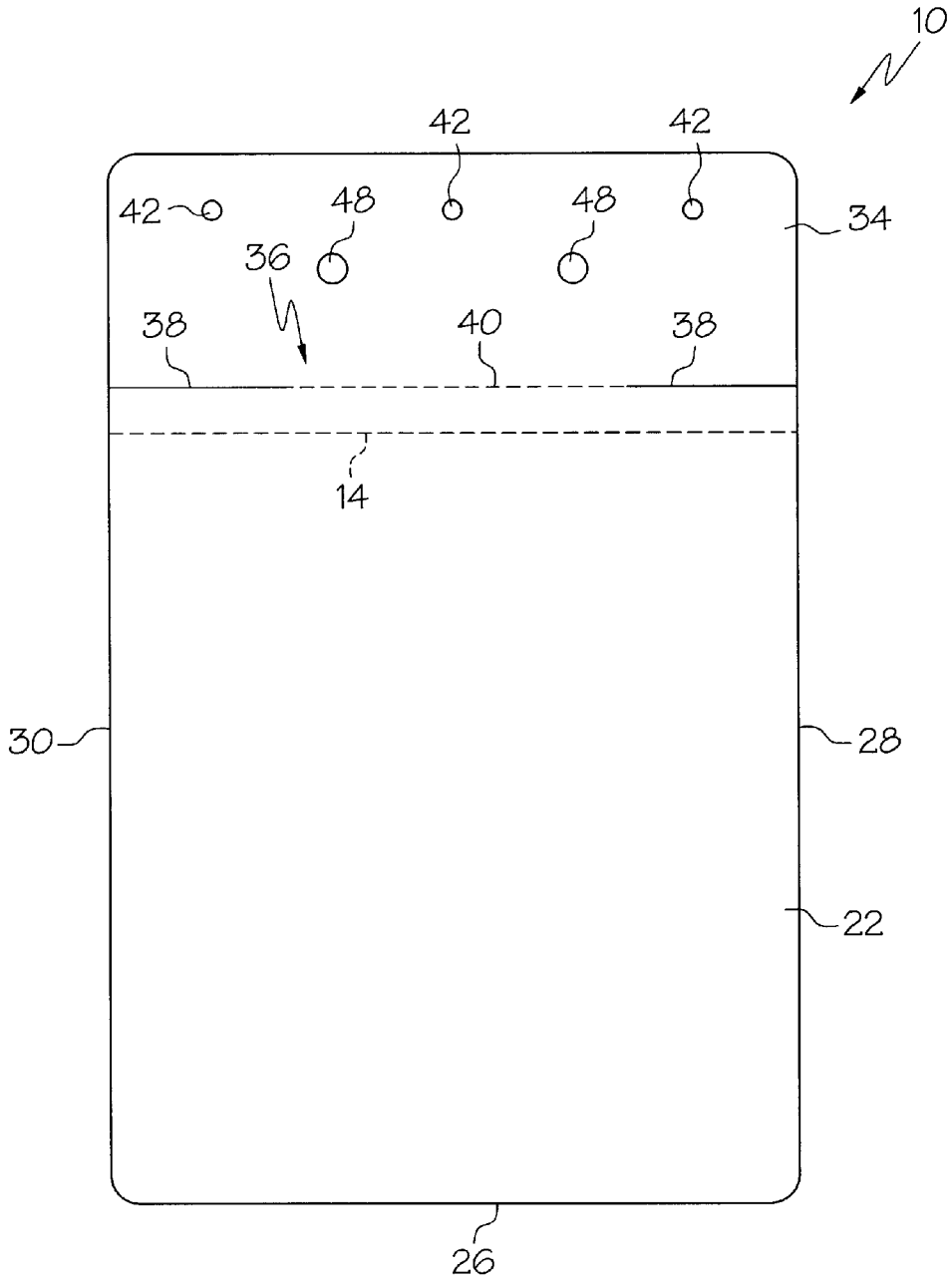
FIG. 2 is a rear view of a bag according to the invention.
Figure 3:
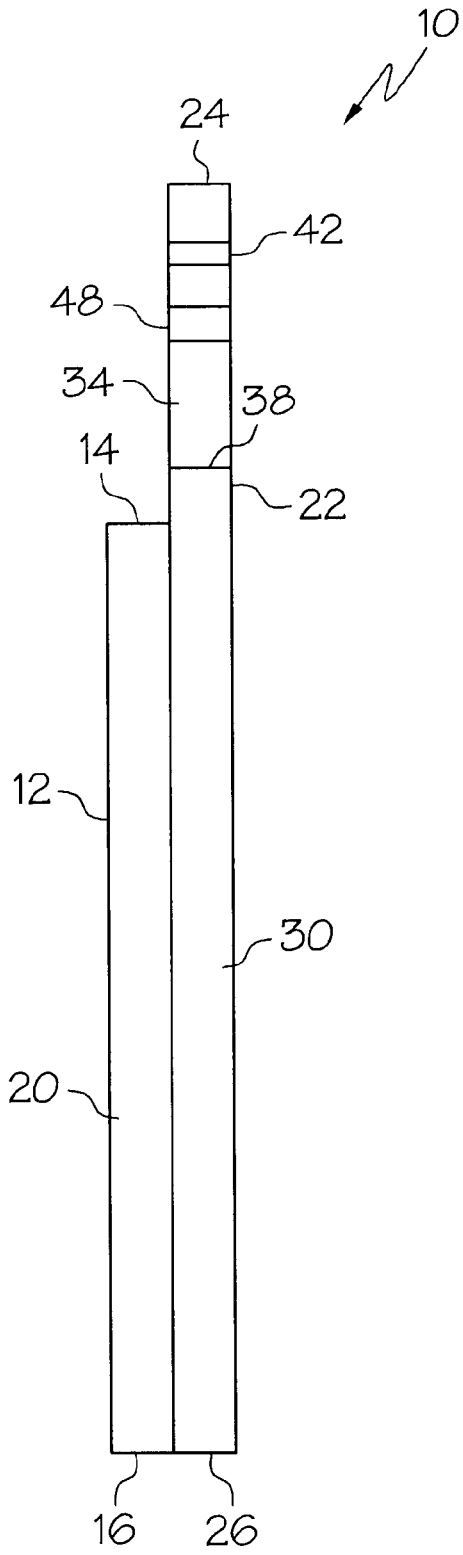
FIG. 3 is a side view of a bag (having exaggerated width) according to the invention.
Figure 4:
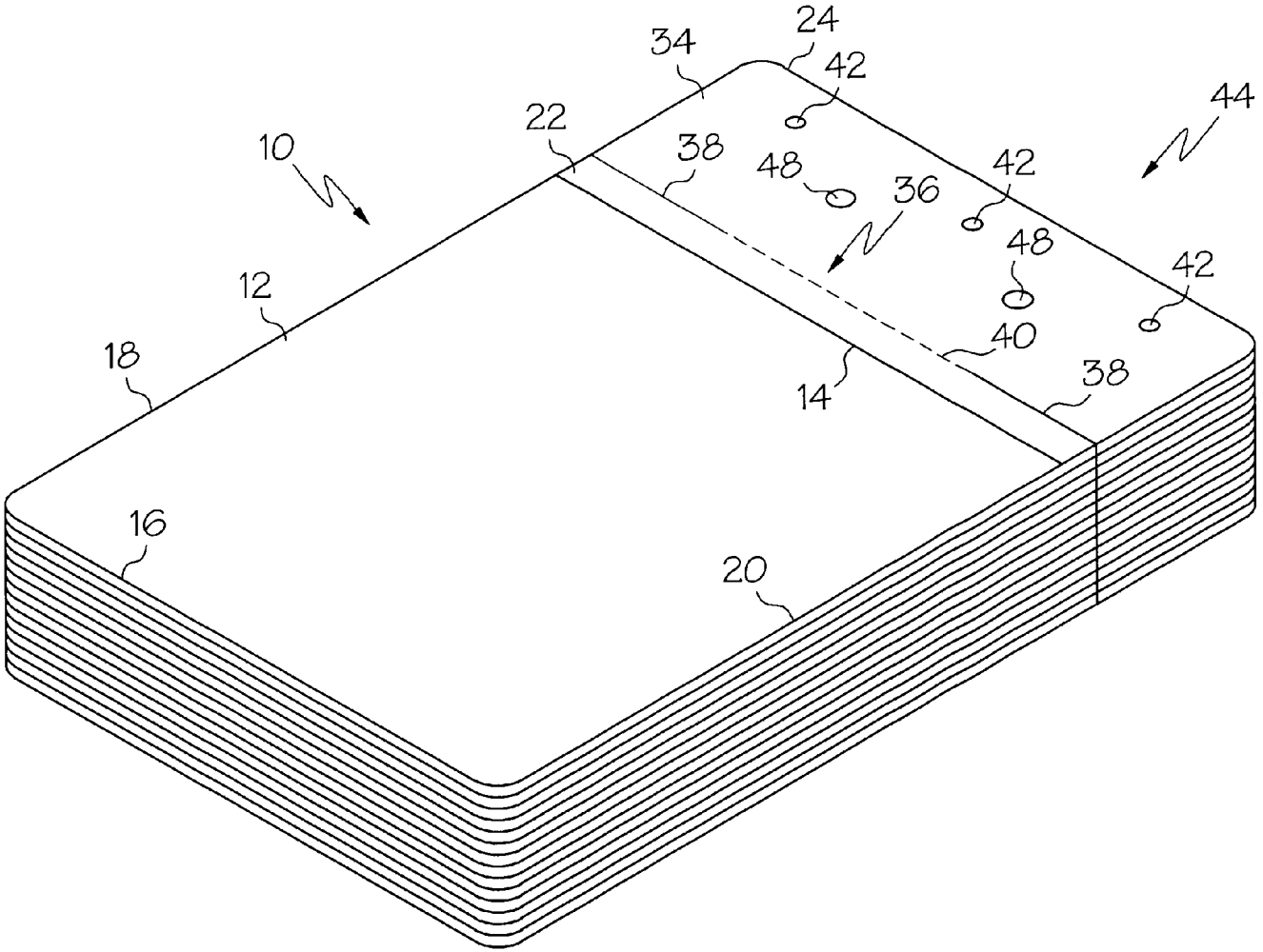
FIG. 4 is a perspective view of a wicketed assembly of bags according to the invention.

Referring to the drawings, FIGS. 1, 2 and 3 illustrate a bag 10 which comprises a front panel 12 having a top edge 14, a bottom edge 16, a first side edge 18 and a second side edge 20, and a back panel 22 having a top edge 24, a bottom edge 26, a first side edge 28 and a second side edge 30. First and second side edges 18 and 20 and bottom edge 16 of front panel 12 are joined to corresponding first and second side edges 28 and 30 and corresponding bottom edge 26 of back panel 22 forming bag 10. The top edge 14 of the front panel 12 defines the mouth 32 of bag 10 (FIG. 4). The back panel 32 extends beyond the top edge 14 of the front panel to provide an upper retaining portion 34 having an upper edge defined by the top edge 24 of the back panel. The lower portion of the back panel 22 detaches from the upper retaining portion 34 along a tear line 36. Opening of the bag

10 is facilitated if the tear line 36 is offset (e.g., about ½ to ¾ inch) above the top edge 14 of the front panel 12. The offset of tear line 36 prevents any fraying of the tear line 24 from interfering with opening subsequent bags positioned deeper in the assembly. In accordance with the invention, the tear line 24 includes two lateral portions 38 which are cut and a middle portion 40 which is perforated. The length of the cuts will vary with the size of the bag. The cut length must enable the bag 10 to open when a jet of air is directed onto the top edge 14 of the bag 10. A cut length of about one-half inch or greater and preferably about one inch is useful with bags ranging from about 7 to 9 inches wide.

The bags which are useful in the present invention are those bags commonly used in bagging fruits, vegetables and other products in the food industry. Typically, the bags are plastic bags such as polyolefin bags, e.g., polyethylene, polypropylene, etc.

FIG. 4 shows an assembly 44 comprising a plurality of the bags 10 illustrated in FIG. 1. The bags are hot melt welded together at hot weld sites 42 in the upper retaining portion 34. Such hot melt weld sites 42 are typically made by a heated needle or rod inserted through the assembly of bags. The hot melt weld sites 42 keep the assembly of bags orderly in a single unit before the assembly is placed on the automatic filling apparatus. The assembly of bags is secured to the automatic filling apparatus (not shown) by at least one wicket 46 (FIG. 5) which fits through preformed wicket holes 48 in the upper retaining portion 34 so that when the assembly of bags is attached to the bagging apparatus, the outermost bag 10 is available to be filled with the product 56 (FIG. 5).

Figure 5:
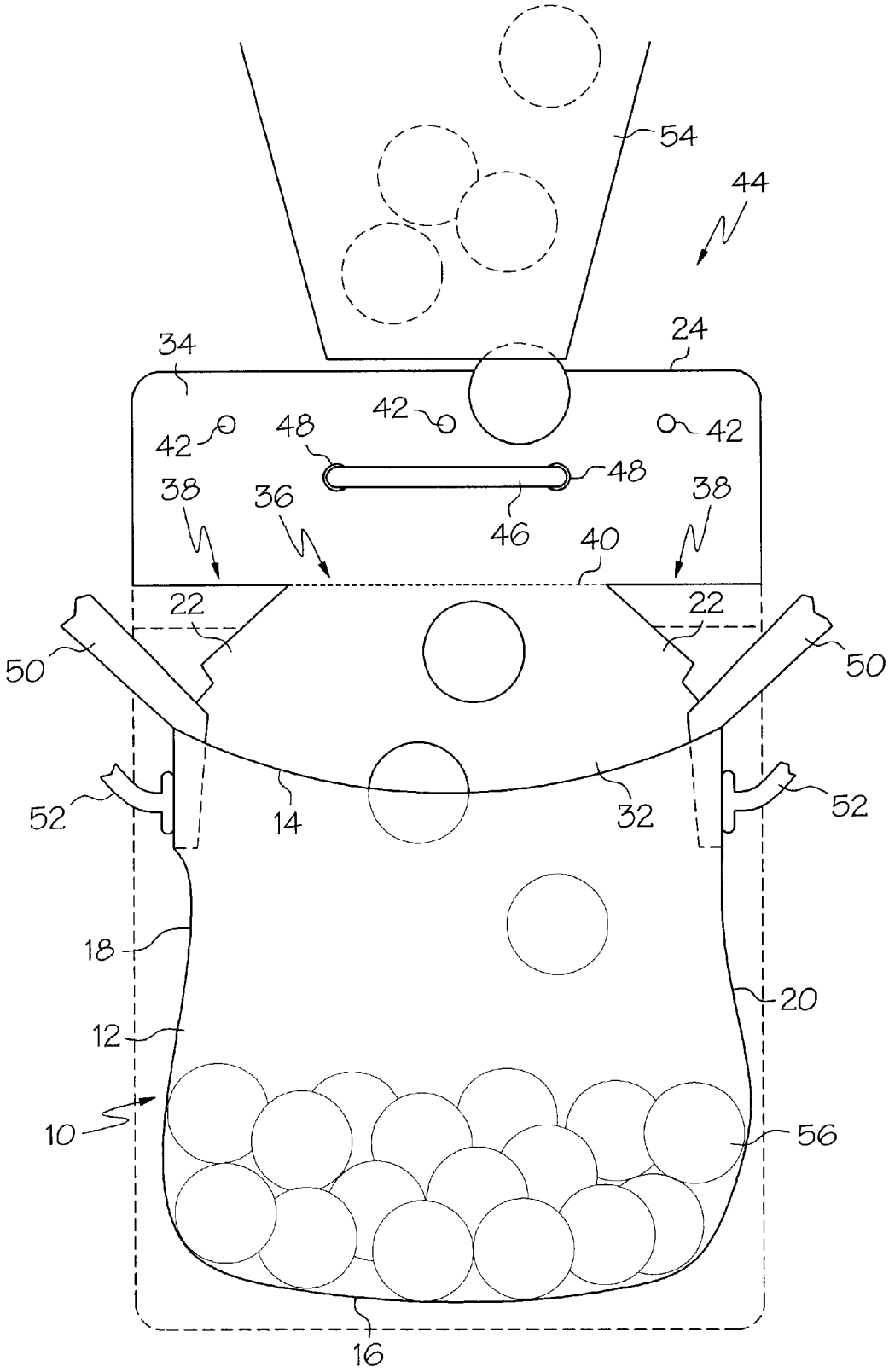
FIG. 5 is a front view of a wicketed bag being filled with product according to the invention.

As illustrated in FIG. 5, the bag 10 is inflated using a continuous or pulsed bursts of air from an air supply in an automatic bagging apparatus (not shown) directed onto the tear line 36 and into the mouth 32 of the outermost bag 10. After inflation of the bag 10, spreader arms 50 and gripper arms 52 are deployed into and on both sides of the bag such that the spreader arms 50 spread the bag open from the inside of the bag and the gripper arms 52 grip the bag from the outside of the bag wherein the sides of the bag 10 are secured between the spreader arms 50 and the gripper arms 52. With the bag 10 held securely by the spreader arms 50 and the gripper arms 52, a predetermined amount of product 56 is metered to the bag 10 from chute 54. When the product 56 is delivered to the bag 10, the bag 10 is torn along perforation 40 and removed from the upper retaining portion 34. The bagging operation is then repeated using the next bag in the wicketed assembly 44. The filled bags are closed by conventional means, e.g., heat sealing, tying, clamping, etc., in a separate step.

While the invention has been described with respect to a bag having a front panel and a back panel, those skilled in the art will recognize that the panels need not be separate. For example, the front panel may be an extension of the back panel in which case the bottom edge of the bag is formed by a fold instead of a seam.

What is claimed is:

1. A method for opening and filling a bag with a product, the bag having a back panel having a top edge and a front panel having a top edge, said back panel including a first side edge and a second side edge, said back panel further including a tear line extending parallel to said top edge of said back panel, said tear line including a middle portion that is perforated and two lateral portions that are cut through said bottom panel and intersect said side edges of said back panel, the bag being a top bag of a wicket of stacked, attached bags, the method comprising the steps of:

inflating said bag with a fluid by directing a fluid jet at said top edge of said back panel, said lateral portions of said tear line enabling said front panel to be pulled away from said back panel, the middle portion of the tear line limiting the movement of said front panel away from said back panel;

gripping said bag on an inside surface of said bag and an outside surface of said bag with a pair of gripper sets, each gripper set including a spreader arm located inside said bag and a gripper arm located outside said bag for gripping said bag therebetween;

filling said inflated bag with said product; and tearing said bag along said perforated line to expose another bag located below said filled bag.

2. The method of claim 1 further comprising the step of releasing said bag such that said gripper sets do not grip said bag.

3. The method of claim 1 wherein said top edge of said back panel is located above said top edge of said front panel during said inflating, gripping, and filling steps.

4. The method of claim 3 wherein said tear line of said bag is located between said top edge of said back panel and said top edge of said front panel, and wherein said inflating step including directing an air jet at said tear line.

5. The bag of claim 1 wherein said bag is of sufficient size to receive produce therein.

* * * * *